US010747146B2

(12) United States Patent
Nagata et al.

(10) Patent No.: US 10,747,146 B2
(45) Date of Patent: Aug. 18, 2020

(54) DEVELOPING DEVICE WITH CLEANING ROLLER AND CLEANING BLADE

(71) Applicant: CANON KABUSHIKI KAISHA, Tokyo (JP)

(72) Inventors: Teppei Nagata, Abiko (JP); Takehiro Kojima, Tokyo (JP); Ryota Fujioka, Kashiwa (JP); Shota Takami, Kamagaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/545,050

(22) Filed: Aug. 20, 2019

(65) Prior Publication Data

US 2019/0369526 A1 Dec. 5, 2019

Related U.S. Application Data

(63) Continuation of application No. PCT/JP2018/007915, filed on Feb. 23, 2018.

(30) Foreign Application Priority Data

Feb. 24, 2017 (JP) ..... 2017-034006

(51) Int. Cl.
*G03G 15/10* (2006.01)
*G03G 15/11* (2006.01)

(52) U.S. Cl.
CPC ..... *G03G 15/11* (2013.01); *G03G 15/10* (2013.01); *G03G 2215/0658* (2013.01)

(58) Field of Classification Search
CPC ..... G03G 15/10; G03G 15/11; G03G 2215/0626; G03G 2215/0629; G03G 2215/0658

(Continued)

(56) References Cited

U.S. PATENT DOCUMENTS 7,215,910 B2 5/2007 Landa et al.
8,737,885 B1 5/2014 Berg (Continued)

FOREIGN PATENT DOCUMENTS

JP 2004-538518 A 12/2004
JP 2009156932 A * 7/2009

(Continued)

OTHER PUBLICATIONS

May 29, 2018 International Search Report in International Patent Appln. No. PCT/JP2018/007915.

*Primary Examiner* — Robert B Beatty
(74) *Attorney, Agent, or Firm* — Venable LLP

(57) ABSTRACT

A developer container is capable of supplying a liquid developer to a portion, of a surface of a cleaning roller, between a cleaning position X and a contact position Y with respect to a rotational direction of the cleaning roller. A free end of a cleaning blade is positioned in a range of 65° or more and less than 95° as a positive angle of the rotational direction of the cleaning roller when a line passing through a center of the cleaning roller and an upper end portion of the cleaning roller with respect to a direction of gravitation is at 0° (reference line G). In this case, the cleaning blade is disposed so that an angle α between a line F perpendicular to a line E connecting the center of the cleaning roller and the free end of the cleaning blade, and the cleaning blade is in a range of 35° or more and less than 60° .

9 Claims, 8 Drawing Sheets

(58) Field of Classification Search
USPC ..... 399/239, 249
See application file for complete search history.

(56) References Cited

U.S. PATENT DOCUMENTS

| | | | | |
|---|---|---|---|---|
| 10,310,418 | B2 | 6/2019 | Torikata et al. | |
| 2004/0005407 | A1* | 1/2004 | Takeuchi | G03G 15/101 427/240 |
| 2004/0175206 | A1 | 9/2004 | Landa et al. | |
| 2011/0067590 | A1 | 3/2011 | Chow et al. | |
| 2012/0213542 | A1 | 8/2012 | Tsukada et al. | |
| 2012/0219325 | A1 | 8/2012 | Sasaki et al. | |
| 2014/0153969 | A1 | 6/2014 | Berg | |
| 2018/0059581 | A1 | 3/2018 | Torikata et al. | |
| 2019/0258193 | A1* | 8/2019 | Nelson | G03G 15/095 |

FOREIGN PATENT DOCUMENTS

| | | | |
|---|---|---|---|
| JP | 2012-173696 | A | 9/2012 |
| JP | 2012-230187 | A | 11/2012 |
| JP | 2014-115652 | A | 6/2014 |
| JP | 2016-224424 | A | 12/2016 |
| WO | 2016/190449 | A1 | 12/2016 |

* cited by examiner

DEVELOPING DEVICE WITH CLEANING ROLLER AND CLEANING BLADE

This application is a continuation of International Patent Appln. No. PCT/JP2018/007915 filed Feb. 23, 2018.

TECHNICAL FIELD

The present invention relates to a developing device for developing an electrostatic latent image with a liquid developer containing toner and a carrier liquid.

BACKGROUND ART

As an image forming apparatus, a constitution in which image formation is carried out using a liquid developer in which toner is dispersed in a carrier liquid has been known. For example, a constitution in which the liquid developer stored in a developer container is supplied to a developing roller by an electrode, and an electrostatic latent image formed on an image bearing member is developed with the toner in the liquid developer carried on the developing roller (Japanese Patent Application 2003-519705 and Japanese Laid-Open Patent Application 2014-115652). Of the liquid developer on the developing roller, the liquid developer remaining on the developing roller without being used for development is removed by a cleaning roller.

In the case of a constitution described in Japanese Patent Application 2003-519705, the liquid developer on the cleaning roller removed from the developing roller is removed by a sponge roller and a blade. Further, in the case of a constituted described in Japanese Laid-Open Patent Application 2014-115652, the liquid developer on the cleaning roller removed from the developing roller is removed by the blade. Further, in Japanese Laid-Open Patent Application 2014-115652, a constitution in which the liquid developer is blown toward the blade and an edge of the blade by a cleaning unit provided with a pump and a nozzle.

PROBLEMS TO BE SOLVED BY THE INVENTION

Here, in the case where an image forming operation is stopped in a state in which the liquid developer remains on member surfaces and between a plurality of members in a developing device, there is a liability that agglomeration of toner particles and deposition of the toner particles on the member occur due to flow and vaporization of the carrier liquid. For this reason, it is not preferable that after the image forming operation is stopped, the liquid developer is left on the cleaning roller and the blade.

Further, the liquid developer removed from the developing roller is a residue after development, and therefore, a toner concentration in the liquid developer is high in some cases. When the toner concentration is high, viscosity of the liquid developer becomes high, so that the liquid developer is not readily scraped off by the blade and the liquid developer scraped off by the blade does not readily flow.

In the case of the constitution described in the above-described Japanese Patent Application 2003-519705, the liquid developer on the cleaning roller is removed by the sponge roller and the blade, but in the case where a removed toner concentration is high, there is a possibility that the liquid developer remains on the blade or the like.

Further, in the case of the constitution described in the above-described Japanese Laid-Open Patent Application 2014-115652, the liquid developer is blown toward the blade or the like by the cleaning upstream, but the cleaning upstream is provided and therefore, the constitution is complicated, and upsizing of the developing device and an increase in manufacturing cost are invited.

The present invention aims at providing a constitution which is capable of removing the liquid developer on the cleaning roller with a simple constitution and in which the liquid developer does not readily remain on the cleaning blade.

MEANS FOR SOLVING THE PROBLEMS

The present invention is a developing device comprising: a developer carrying member, rotatable while carrying a liquid developer containing toner and a carrier liquid, for developing an electrostatic latent image carried on the developer carrying member, with the toner at a developing position; a cleaning roller rotatable while removing the liquid developer on the developer carrying member at a cleaning position on a side downstream of the developing position with respect to a rotational direction of the developer carrying member; a cleaning blade for scraping off the liquid developer on the cleaning roller in contact with the cleaning roller at a contact position on a side downstream of the cleaning position with respect to a rotational direction of the cleaning roller; and a developer container storing the liquid developer and capable of supplying the stored liquid developer to the developer carrying member and a portion of a surface of the cleaning roller between the cleaning position and the contact position with respect to the rotational direction of the cleaning roller.

Assuming that the cleaning blade is in a free state, the cleaning blade is provided so that when a line passing through a center of the cleaning roller and an upper end portion of the cleaning roller with respect to a direction of gravitation is at 0°, an angle of the rotational direction of the cleaning roller is a positive angle and a free end of the cleaning blade is positioned in a range of 65° or more and less than 95° and so that an angle, formed on a downstream side of the rotational direction of the cleaning roller, between a line perpendicular to a line connecting the center of the cleaning roller and the free end of the cleaning blade, and the cleaning blade is in a range of 35° or more and less than 60°.

Or, assuming that the cleaning blade is in a free state, the cleaning blade is provided so that when a line passing through a center of the cleaning roller and an upper end portion of the cleaning roller with respect to a direction of gravitation is at 0°, an angle of the rotational direction of the cleaning roller is a positive angle and a free end of the cleaning blade is positioned in a range of 95° or more and less than 180° and so that an angle, formed on a downstream side of the rotational direction of the cleaning roller, between a line perpendicular to a line connecting the center of the cleaning roller and the free end of the cleaning blade, and the cleaning blade is in a range of 30° or more and less than 60°.

EFFECT OF THE INVENTION

According to the present invention, the liquid developer on the cleaning roller can be removed with a simple constitution and the liquid developer can be made hardly remaining on the cleaning blade.

EMBODIMENTS FOR CARRYING OUT THE INVENTION

First Embodiment

First Embodiment will be described using FIG. 1 to FIG. 9. First, a schematic structure of an image forming apparatus of this embodiment will be described using FIG. 1 and FIG. 2.

[Image Forming Apparatus]

Figure 1:
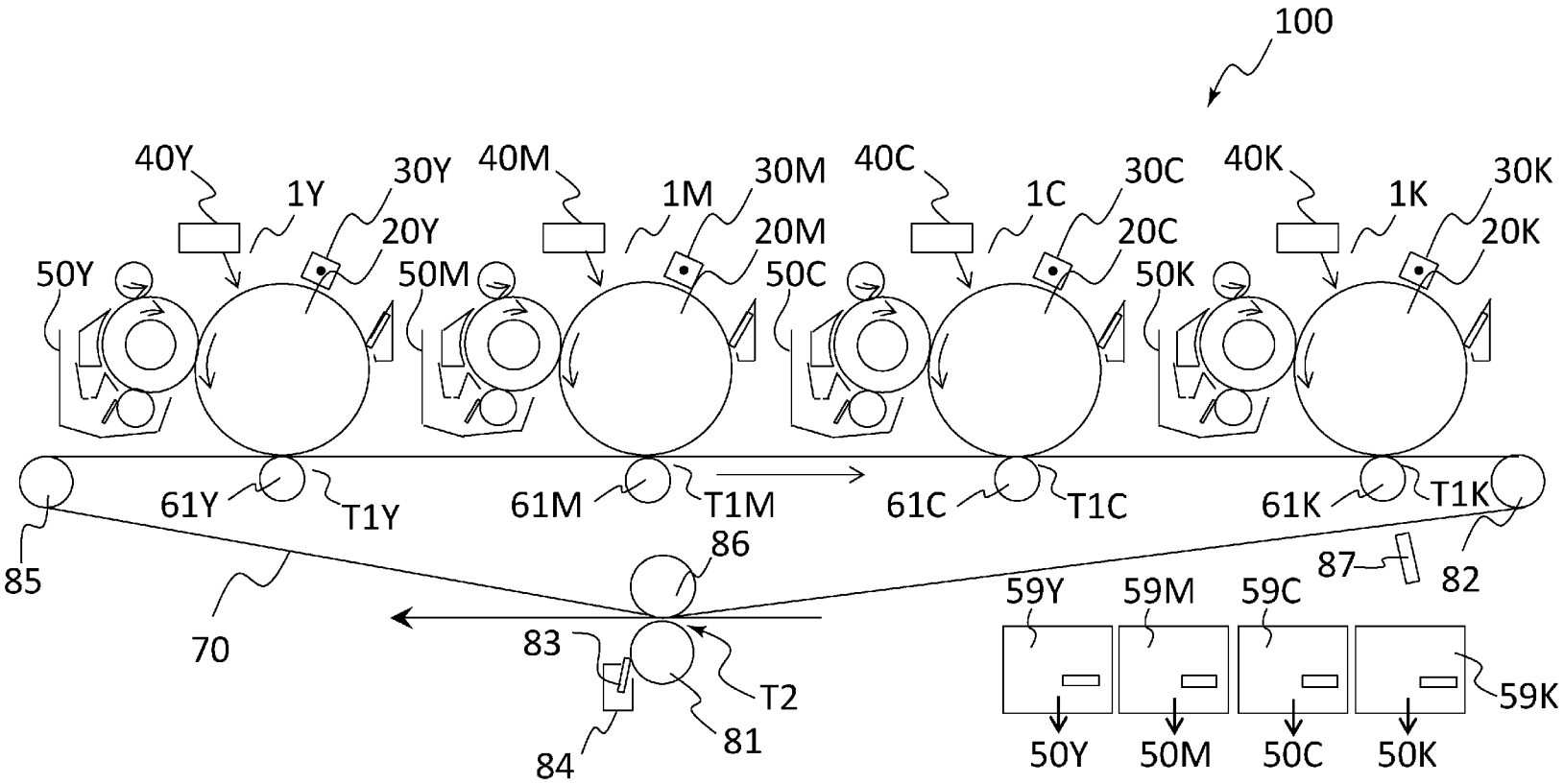
FIG. 1 is a schematic structural view of an image forming apparatus according to First Embodiment.

As shown in FIG. 1, an image forming apparatus 100 is a full-color printer of an electrophotographic type in which four image forming portions 1Y, 1M, 1C and 1K provided correspondingly to four colors of yellow (Y), magenta (M), cyan (C) and black (K). In this embodiment, the image forming apparatus 100 is of a tandem type in which the image forming portions 1Y, 1M, 1C and 1K are provided along a rotational direction of an intermediary transfer belt 70 described later. The image forming apparatus 100 forms a toner image on a recording material depending on an image signal from an external device communicatably connected with an image forming apparatus main assembly, for example. As the recording materials, a sheet material such as a sheet, a plastic film, a cloth or the like is cited.

The respective image forming portions 1Y, 1M, 1C and 1K form toner images of the respective colors on photosensitive members 20Y, 20M, 20C and 20K (on image bearing members) as image bearing members with use of liquid developers each containing toner and a carrier liquid. Detailed structures of the image forming portions will be described later.

The intermediary transfer belt 70 as an intermediary transfer member is an endless belt stretched by a driving roller 82, a follower roller 85 and an inner secondary transfer roller 86, and is rotationally driven while being contacted to the photosensitive members 20Y, 20M, 20C and 20K and an outer secondary transfer roller 81. At positions opposing the photosensitive members 20Y, 20M, 20C and 20K through the intermediary transfer belt 70, primary transfer rollers 61Y, 61M, 61C and 61K are provided and form primary transfer portions T1Y, T1M, T1C and T1K. Further, at the primary transfer portions T1Y, T1M, T1C and T1K, the four color toner images are successively transferred superposedly from the photosensitive members 20Y, 20M, 20C and 20K onto the intermediary transfer belt 70, so that a full-color toner image is formed on the intermediary transfer belt 70. Incidentally, for example, only a toner image of a single color such as a black can also be formed on the intermediary transfer belt 70.

At a position opposing the inner secondary transfer roller 86 through the intermediary transfer belt 70, the outer secondary transfer roller 81 is provided and forms a secondary transfer portion T2. The single-color toner image or the full-color toner image formed on the intermediary transfer belt 70 is transferred onto the recording material at the secondary transfer portion T2. That is, at the secondary transfer portion T2, a voltage of, for example, +1000 V is applied to the outer secondary transfer roller 81, and the inner secondary transfer roller 86 is kept at 0 V, so that toner particles on the intermediary transfer belt 70 are secondary-transferred onto a surface of the recording material.

Incidentally, the liquid developer which is not transferred on the recording material is removed by a cleaning device (not shown) contacting the intermediary transfer belt 70. To the outer secondary transfer roller 81, a blade 83 is contacted, and the liquid developer deposited on the outer secondary transfer roller 81 is scraped off by the blade 83 and is collected in a collecting portion 84. The toner image transferred on the recording material is fixed on the recording material by an unshown fixing device.

Further, on the intermediary transfer belt 70, a test image for monitoring an image density is periodically drawn (formed) between image forming operations, and the density thereof is detected by a toner image density sensor 87 provided upstream of the secondary transfer portion T2. In this embodiment, the toner image density sensor 87 is an optical sensor and detects the density of the toner image from intensity of specular reflection light and diffused reflection light of LED light with which the test image is irradiated. On the basis of information on the detected toner image density, optimization of the image density is carried out by feed-back-control. Specifically, the image density is adjusted by adjusting a voltage applied to a film forming electrode 51 described later.

[Image Forming Portion]

The image forming portions 1Y, 1M, 1C and 1K will be described using FIG. 1 and FIG. 2. The image forming portions 1Y, 1M, 1C and 1K include developing devices 50Y, 50M, 50C and 50K, respectively. The developing devices 50Y, 50M, 50C and 50K accommodate liquid developers containing toner particles which develop the colors of yellow (Y), magenta (M), cyan (C) and black (K), respectively. Further, the developing devices 50Y, 50M, 50C and 50K have functions of developing electrostatic latent images formed on the photosensitive members 20Y, 20M, 20C and 20K, by the respective liquid developers.

Incidentally, the four image forming portions 1Y, 1M, 1C and 1K have the substantially same constitution except that development colors are different from each other. Accordingly, in the following, the image forming portion 1K will be described as a representative with use of FIG. 2, and other image forming portions will be omitted from description. Incidentally, as regards reference numerals or symbols of respective portions in FIG. 1, the portions are represented by adding suffixes (Y, M, C, K) corresponding to the respective colors to the reference numerals or symbols.

At a periphery of the photosensitive member 20K, along a rotational direction thereof, a charging device 30K for electrically charging the photosensitive member 20K, an exposure device 40K for forming the electrostatic latent image on the charged photosensitive member 20K, the developing device 50K, a cleaning device 21K and the like are provided.

The photosensitive member 20K is a photosensitive drum formed in a cylindrical shape and includes a cylindrical base material and a photosensitive layer formed on an outer peripheral surface of the base material, and is rotatable about a center axis thereof. The photosensitive member 20K is constituted by an organic photosensitive member or an amorphous silicon photosensitive member. In this embodiment, as regards the photosensitive member 20K, the photosensitive layer was formed by a mixture of amorphous silicon and amorphous carbon, and a diameter was 84 mm. The photosensitive member 20K is capable of carrying the electrostatic latent image described below. In this embodiment, the photosensitive member 20K rotates in the counterclockwise direction as shown by an arrow in FIG. 2.

The charging device 30K is a device for electrically charging the photosensitive member 20K. In this embodiment, a corona charger is used as the charging device 30K. The charging device 30K is provided upstream of a nip between the photosensitive member 20K and a developing roller 54K described later, and a bias of the same polarity as a charge polarity of the toner is applied to the charging device 30K from an unshown power (voltage) source, and thus the photosensitive member 20K is electrically charged. In this embodiment, the surface of the photosensitive member 20K is electrically charged to −500 V by applying a voltage of about −4.5 kV to −5.5 kV to a charging wire of the charging device 30K.

The exposure device 40K includes a semiconductor laser, a polygon mirror, an F-θ lens and the like, and the charged photosensitive member 20K is irradiated with laser light modulated correspondingly to the image signal, so that the electrostatic latent image is formed on the photosensitive member 20K. That is, the electrostatic latent image is carried on the photosensitive member 20K. In this embodiment, the electrostatic latent image is formed on the surface of the photosensitive member 20K so that an image portion potential is made about −100 V by the exposure device 40K.

The developing device 50K is a device for developing the electrostatic latent image, formed on the photosensitive member 20K, with the toner of black (K). Details of the developing device 50K will be described later. The toner image formed on the photosensitive member 20K is primary-transferred onto the intermediary transfer belt 70 by applying a transfer voltage between the primary transfer roller 61K and the photosensitive member 20K. The cleaning device 21K includes a cleaning blade 21Ka and a collecting portion 21Kb and is capable of collecting the liquid developer on the photosensitive member 20K after the primary transfer.

[Developing Device]

Next, a structure of the developing device 50K in this embodiment will be described using FIG. 2. The developing device 50K includes the developing roller 54 as a developer carrying member for carrying the liquid developer to the photosensitive member 20K. At a periphery of the developing roller 54, a developer container 53, a film forming electrode 51, a drawing roller 52, and a cleaning roller 58 as a collecting roller are provided.

To the developing roller 54, the film forming electrode 51, the drawing roller 52 and the cleaning roller 58, voltages are applied from voltage sources, respectively, described later. Then, depending on potential differences between the voltages applied to the respective members, toner particles in the liquid developer move in desired directions by electrophoresis. Incidentally, all the voltages applied to the respective members comprising the developing roller 54, the film forming electrode 51, the drawing roller 52 and the cleaning roller 58 are negative voltages.

The developing roller 54 rotates while carrying the liquid developer containing the toner and the carrier, and develops, with the toner at a developing position opposing the photosensitive member 20K, the electrostatic latent image carried on the photosensitive member 20K. The developing roller 54 is a cylindrical member of 42 mm in diameter and rotates about a center axis thereof in the clockwise direction indicated by an arrow P in FIG. 2. Specifically, the developing roller 54 includes a core metal of stainless steel, and on an outer peripheral surface of the core metal, a 5 mm-thick elastic layer of an electroconductive polymer is formed.

A surface layer member of the developing roller 54 is an electroconductive elastic layer in which as an electric resistance adjusting material, electroconductive fine particles are mixed and dispersed in a resin material. As the resin material, it is possible to cite EPDM, urethane, silicone, nitrile-butadiene rubber, styrene-butadiene rubber and butadiene rubber. Further, as the surface layer member, it is possible to cite a member comprising a base material comprising a dispersion-type resistance adjusting resin material in which as the electric resistance adjusting resin material, electroconductive fine particles, for example, either one or a plurality of carbon black and titanium oxide are dispersed and mixed in a resin material selected from the above-described resin materials. Or, as the surface layer member, it is possible to cite a member using, as a base material, an electric resistance adjusting resin material in which an ion conductive material, for example, either one or a plurality of inorganic ion conductive materials such as sodium perchlorate, calcium perchlorate and sodium chlorate are used in the above-described resin material.

As regards the surface layer member, volume resistivity is adjusted to $1\times10^{2}$–$1\times10^{12}\Omega\cdot$cm inclusive of variation. Further, in the case where a foaming agent is used in a foaming and mixing step for obtaining elasticity, a silicone-based surfactant (polydiallylsiloxane, polysiloxane-polyalkylenoxide block copolymer) is suitable. In this embodiment, the surface layer of the developing roller 54 is an electroconductive urethane rubber, and inside the surface layer of the developing roller 64, the ion-conductive agent is uniformly dispersed, so that the volume resistivity is adjusted to $1\times10^{5}$–$1\times10^{7}\Omega\cdot$cm in an initial state.

The developer container 53 stores the liquid developer in which the toner particles of black are dispersed in the carrier liquid. The liquid developer used in this embodiment is prepared by adding the particles, in which a colorant such as a pigment is dispersed principally in a polyester-based resin material and which are of 0.7 μm in average particle size, together with a dispersant, a toner charge control agent and a charge-directing agent into the liquid carrier such as an organic solvent. Further, in this embodiment, the surfaces of the toner particles are charged to a negative polarity in a certain amount. Incidentally, specific gravity of the toner particles and specific gravity of the carrier liquid are 1.35 g/cm$^3$ and 0.83 g/cm$^3$, respectively. A movement amount and a pressing amount of the toner particles and controlled by adjusting the potential differences between the respective members.

Further, the developer container 53 is capable of supplying the stored liquid developer to the developing roller 54. That is, the developer container 53 accommodates the liquid developer, for developing the electrostatic latent image formed on the photosensitive member 20K, in order to be supplied to the developing roller 54.

The liquid developer stored in the developer container 53 is supplied from a mixer 59K. To the mixer 59K, the carrier liquid and the toner are supplied appropriately from a carrier tank storing a carrier liquid for supply and a toner tank storing toner for supply, respectively, for example. In the mixer 59K, a stirring blade driven by an unshown motor is accommodated and mixes the supplied carrier liquid and the supplied toner with each other by stirring thereof, and thus disperses the toner in the carrier liquid.

In the mixer 59K, a toner particle concentration (toner concentration, T/D) of the liquid developer is appropriately adjusted. Incidentally, the toner concentration is a weight percentage concentration (wt %) of the toner particles in the liquid developer. In this embodiment, the liquid developer adjusted in the mixer 59K so that T/D is 3.5±0.5 wt % is supplied to the developer container 53 from a developer supplying opening 531 connected with the mixer 59K.

Incidentally, the developer container 53 is provided with guiding member 533 forming a flushing flow path 57 described later and with a developer discharging hole 532. The liquid developer in the developer container 53 leaks out thereof from the developer discharging hole 532 provided at the bottom of the developer container 53, and is collected in a developer collecting container 55. For this reason, in the case where supply of the liquid developer to the developer container 53 during a stop of the image forming operation or the like, an amount of the liquid developer accommodated in the developer container 53 gradually decreases, and finally, the developer container 53 becomes empty.

Figure 3:
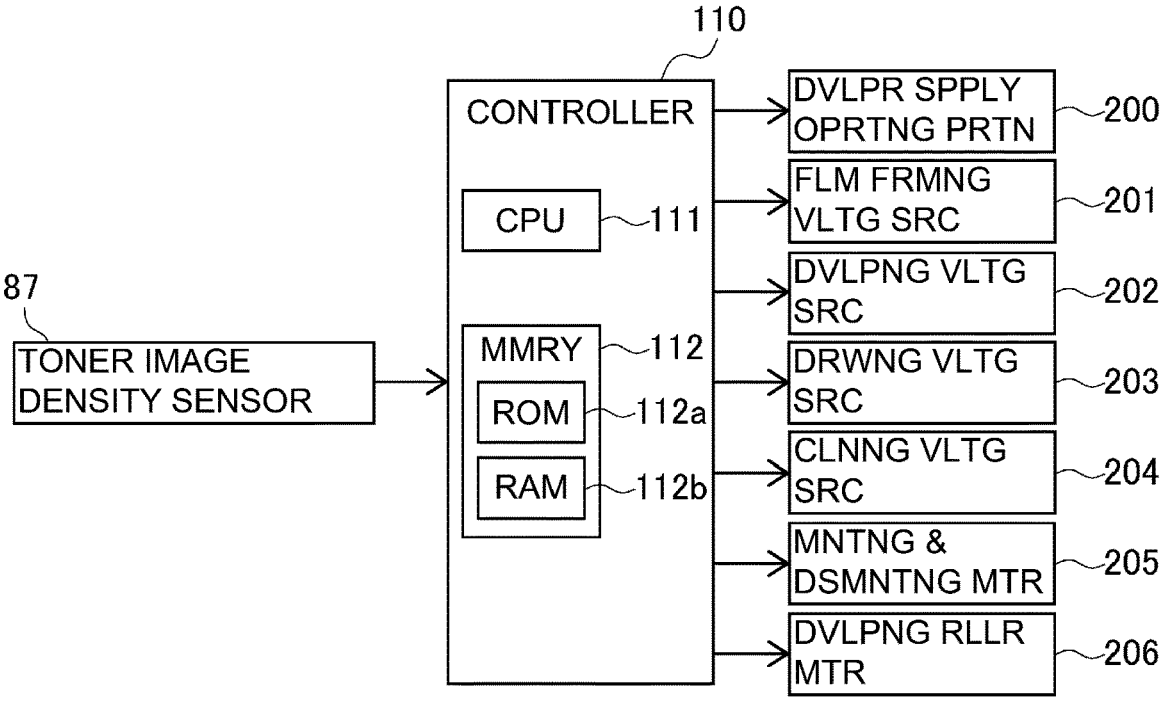
FIG. 3 is a control block diagram of the image forming apparatus according to the First Embodiment.

The film forming electrode 51 causes the developing roller 54 to carry thereon the liquid developer from the developer container 53 and attracts the toner particles toward the developing roller 54 side by the action of an electric field. That is, the film forming electrode 51 is disposed opposed to the developing roller 54 at a position upstream of the developing position with respect to the rotational direction of the developing roller 54 with a predetermined gap from the developing roller 54. Further, the film forming electrode 51 forms a film of the liquid developer, on the developing roller 54, supplied from the developer container 53 so as to provide a desired toner concentration by being supplied with a predetermined film forming voltage from a film forming power (voltage) source 201 (FIG. 3).

Specifically, the film forming electrode 51 is 24 mm in circumferential length of a surface opposing the developing roller 54 and forms a gap (predetermined gap) of 400±100 μm with the developing roller 54. The liquid developer supplied to the developer container 53 is drawn into the gap between the film forming electrode 51 and the developing roller 54 by rotation of the developing roller 54 as shown by an arrow A of FIG. 2. Then, by a difference in applied voltage between the film forming electrode 51 and the developing roller 54, the toner particles are drawn toward the developing roller 54 side by the electric field generated in the predetermined gap.

The drawing roller 52 is provided downstream of the film forming electrode 51 and upstream of the developing position with respect to the rotational direction of the developing roller 54, and compresses the toner layer in the liquid developer formed in the film on the developing roller 54 (on a developer carrying member) is compressed. That is, the drawing roller 52 shifts the toner particles, contained in the liquid developer formed in the film on the developing roller 54, toward the developing roller 54 side under application of a predetermined drawing voltage from a drawing power (voltage) source 203 (FIG. 3), and at the same time, draws and collects an excessive carrier liquid.

Such a drawing roller 52 is a cylindrical member formed of metal, and in this embodiment, a roller formed of stainless steel in a diameter of 16 mm is used as the drawing roller 52. The drawing roller 52 is contacted to the developing roller 54 so that pressure is constant (35±5 N in this embodiment) over a longitudinal direction (rotational axis direction of the developing roller 54, 354 mm in this embodiment). Further, the drawing roller 52 rotates in the counterclockwise direction as shown in FIG. 2.

The liquid developer raised from the developer container 53 and passed through the film forming electrode 51 is carried in a certain amount on the developing roller 54. For that reason, as shown in FIG. 2, of the liquid developer conveyed at a predetermined speed to a contact portion between the drawing roller 52 and the developing roller 54, a portion existing on the surface of the developing roller 54 stably forms a nip between the drawing roller 52 and the developing roller 54. In this embodiment, the gap in the nip is about 6 μm, and a width of the nip with respect to the rotational direction is about 3 mm.

In this nip, by the electric field generated by the difference in applied voltage between the drawing roller 52 and the developing roller 54, the toner particles are pressed toward the developing roller 54 side. In the neighborhood of an outlet between the drawing roller 52 and the developing roller 54, the liquid developer is separated into those on the respective roller surfaces, and the respective liquid developers are carried on the rollers, respectively. At this time, almost all the toner particles and the carrier liquid are carried on the developing roller 54 side, and only the carrier liquid is carried on the drawing roller 52 side. For this reason, T/D of the liquid developer line formed on the developing roller 54 is 10 times or more higher compared with T/D of the liquid developer in the developer container 53. Incidentally, in this embodiment, T/D in the developer liquid of the surface of the developing roller 54 after passing through the nip is 50±5 wt %.

Figure 2:
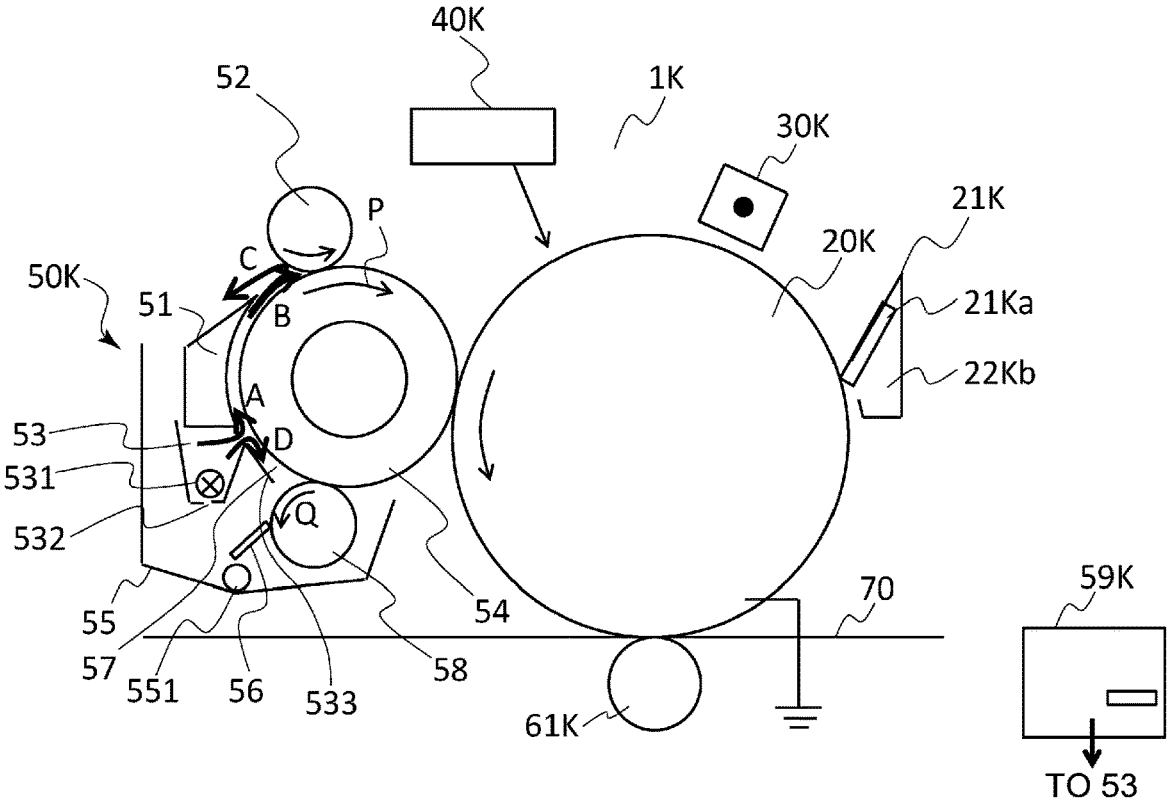
FIG. 2 is a schematic structural view of an image forming portion according to the First Embodiment.

On the other hand, the liquid developer which passed through the gap between the film forming electrode 51 and the developing roller 54 and which thereafter does not enter the gap between the drawing roller 52 and the developing roller 54 is repelled by the drawing roller 52 as shown by an arrow C of FIG. 2. Then, the liquid developer is caused to flow on a back surface of the film forming electrode 51 and is collected in the developer collected container 55.

The cleaning roller 58 collects the toner particles on the developing roller 54 which do not contribute to image formation at the developing position, by the action of the electric field. That is, the development cleaning roller 58 is provided at a cleaning position downstream of the developing position with respect to the rotational direction of the developing roller 54, and removes the toner, which passes through the developing position and which remains on the developing roller 54, under application of a cleaning voltage from a cleaning power (voltage) source 204. Specifically, the cleaning roller 58 rotates while removing the liquid developer on the developing roller 54 by an electric field generated by an applied voltage difference between itself and the developing roller 54. The cleaning roller 58 is contacted to the surface of the developing roller 54 and rotates in the counterclockwise direction shown by an arrow Q in FIG. 2, and is a roller formed of stainless steel or aluminum, for example. In this embodiment, as the cleaning roller 58, a roller formed of the stainless steel in a diameter of 16 mm is used.

The toner collected by the cleaning roller 58 is removed by a cleaning blade 56 as a cleaning blade. The cleaning blade 56 is provided, with respect to the rotational direction of the cleaning roller 58, at a contact position on a side downstream of a position (cleaning position) opposing the developing roller 54 so as to contact the cleaning roller 58. Then, the cleaning roller 58 from which the developer is removed by the cleaning blade 56 performs removal of the liquid developer from the developing roller 54 again. The cleaning blade 56 is a blade which is formed of stainless steel and which is 0.1 mm in thickness and 8 mm in free length. The cleaning blade 56 is, as described specifically later, contacted counterdirectionally to the cleaning roller 58.

In this embodiment, an image forming process speed is 785 mm/s, and the above-described respective rollers contributing to the image formation rotate so that respective surface peripheral speeds are 785 mm/s.

[Control of Image Forming Apparatus]

Next, a constitution of a control system in the above-described image forming apparatus 100 will be described using FIG. 3. In a controller 110, a CPU (Central Processing Unit: central processing unit) 111 is provided. Further, in a memory 112, ROM (Read Only Memory) 112*a* is provided. In the ROM 112*a*, a program corresponding to a control procedure is stored. The CPU 111 controls respective portions while reading data and programs written in advance in the ROM 112*a*. In the memory 112, also RAM (Random Access Memory) 112*b* in which operation data and input data read from respective sensors are stored is provided. The CPU 111 effects control by making reference to the data stored in the RAM 112*b* on the basis of the above-described programs or the like.

Further, the CPU 111 is also connected with a toner image density sensor 87. The CPU 111 adjusts, for example, a voltage applied to the film forming electrode 51 on the basis of a detecting result of the toner image density sensor 87. Further, the CPU 111 is connected with, as destination of control, a developer supply operation portion 200, a film forming voltage source 201, a developing voltage source 202, a drawing voltage source 203, a cleaning voltage source 204, a development mounting and dismounting voltage source 205, a developing roller motor 206 and the like. The developer supply operation portion 200 is, for example, a valve, a pump and the like and supplies the liquid developer to the developer container 53 by an instruction from the CPU 111.

The film forming voltage source 201, the developing voltage source 202, the drawing voltage source 203 and the cleaning voltage source 204 are capable of variably applying voltages to the film forming electrode 51, the developing roller 54, the drawing roller 52 and the cleaning roller 58, respectively. The development mounting and dismounting motor 205 causes the developing device 50K as described later, so that the developing roller 54 is contacted to and separated from the photosensitive member 20K. A developing roller motor 206 rotationally drives the developing roller 54. Incidentally, the above constitutions are similar for the developing devices 50Y, 50M and 50C.

[Image Forming Operation]

An image forming operation of the image forming apparatus 100 will be described. Incidentally, also in the following, description will be made using the image forming portion 1K, but such description applies to the other image forming portions. The liquid developer containing a toner particle layer carried on the developing roller 54 forms a visible image in the developing position which is an opposing portion between the developing roller 54 and the photosensitive member 20K, by following the latent image drawn (formed) on the photosensitive member K as specifically described in the following.

As described above, the electrostatic latent image formed on the photosensitive member 20K on a side upstream of the developing position is developed with the toner particles in the developing position and becomes the visible image. In the developing position, from the developing voltage source 202 to the developing roller 54, a developing bias of about −300 V is applied in this embodiment. By this, in accordance with an electric field formed by the electrostatic latent image (image portion: −100 V, non-image portion: −500 V) on the photosensitive member 20K, at the image portion, the toner particles move onto the photosensitive member 20K by electrophoresis. On the other hand, at the non-image portion, the electric field acts in a direction in which the toner particles are pressed against the developing roller 54, and therefore, the toner particles remain on the developing roller 54 as they are. By this, the visible image with the toner particles is formed on the photosensitive member 20K.

The toner particles moved onto the photosensitive member 20K at the developing position is subjected to an image forming process on a downstream side and are primary-transferred onto the intermediary transfer belt 70. At the primary transfer portion, the photosensitive member 20K and the intermediary transfer belt 70 oppose each other, and to the back surface of the intermediary transfer belt 70, a primary transfer roller 61K is contacted. To the primary transfer roller 61K, a voltage of an opposite polarity (+200 to +300 V in this embodiment) to the charge polarity of the toner particles is applied, so that the toner image formed on the photosensitive member 20K moves onto the intermediary transfer belt 70 by electrophoresis. On the photosensitive member 20K, the carrier liquid and the toner in a slight amount of about several % remain, but are scraped off by the cleaning device 21K disposed on a side downstream of the primary transfer portion T1K.

On the other hand, the toner particles remaining on the developing roller 54 go to a collecting and re-using process. That is, on the developing roller 54, the cleaning roller 58 is contacted on a side downstream of the developing position. In a nip between the developing roller 54 and the cleaning roller 58, an electric field is generated by a difference between voltages applied from the developing voltage source 202 and the cleaning voltage source 204 to the developing roller 54 and the cleaning roller 58, respectively. The toner particles on the developing roller 54 which do not contribute to the image formation in the developing position enter the nip, and almost all the toner particles move toward the surface of the cleaning roller 58 by electrophoresis.

To the cleaning roller 58, the cleaning blade 56 is contacted. The liquid developer containing the toner particles collected from the developing roller 54 to the surface of the cleaning roller 58 is scraped off at a contact position between a free end of the cleaning blade 56 and the cleaning roller 58 and flows toward the developer collecting container 55 along inclination of the cleaning blade 56.

In this embodiment, when the image formation is carried out, supply of the liquid developer from the mixer 59K toward the developer container 53 is continuously performed. At that time, the supplied liquid developer moves between the film forming electrode 51 and the developing roller 54 and is carried on the developing roller 54. Or, the liquid developer moves toward the flushing flow path 57 described later and contributes to flushing on the cleaning roller 58 (on the cleaning roller).

Further, a part of the liquid developer supplied toward the developer container 53 is leaked out from the developer container 53 to the developer collecting container 55 through the developer discharge opening 532. When the supply of the liquid developer toward the developer container 53 is stopped, there is no supply of the liquid developer onto the developing roller 54 and the flushing flow path 57, and thereafter, the liquid developer is gradually leaked out through the developer discharge opening 532, so that the inside of the developer container 53 finally becomes empty.

Further, during the image forming operation, voltages are applied to the developing roller 54, the film forming electrode 51, the drawing roller 52 and the cleaning roller 58, respectively, and provide a driving force for electrophoresis of the toner particles. In this embodiment, the voltages applied to the developing roller 54, the drawing roller 52 and the cleaning roller 58 are −300 V, −370 V and −150 V, respectively. The voltage applied to the film forming electrode 51 is controlled by the image density detected by a toner image density sensor 87 provided on the intermediary transfer belt 70. This is due to that mobility (moving speed relative to electric field intensity) of the toner particles in the liquid developer contributing to the image formation changes depending on a consumption status or the like of the toner particles. Incidentally, in a typical situation, the voltage applied to the film forming electrode 51 is −600 to −900 V.

Here, the developing device 50K including the developing roller 54 operates so that the developing roller 54 is contacted to and separated from the photosensitive member K in a direction of the photosensitive member 20K by the development mounting and dismounting motor 205. In this embodiment, during the image forming operation, the developing roller 54 and the photosensitive member 20K contact each other with a contact pressure of 80±10 N. Before and after the image forming operation, the respective operations of the developing roller 54 and the photosensitive member 20K are stopped in a separated state. Incidentally, these operations are similar for the developing devices 50Y, 50M and 50C.

Further, the developing roller 54, the drawing roller 52 and the developing roller 58 rotate at substantially the same surface peripheral speeds, respectively, during the image formation. A driving force for rotation is given to the developing roller 54 by the developing roller motor 206, and the driving force is divided from the developing roller 54 into the drawing roller 52 and the cleaning roller 58 via gears. For this reason, in this embodiment, these three rollers simultaneously start and stop their rotating operations.

[Toner Concentration of Liquid Developer Collected by Cleaning Roller]

As regards the liquid developer collected by the cleaning roller 58, depending on the image formed at the developing position, the concentration of the toner particles contained in the liquid developer (i.e., T/D) is different. Of these, the case where the T/D is highest is the case where a whole surface solid white image is formed at the developing position. The whole surface solid white image is an image with an image ratio of 0% formed on an entire surface of an image region. In this case, the T/D of the liquid developer collected on the surface of the cleaning roller 58 is about 65 wt % which is very high. Further, before and after the image formation is carried out, the toner particles formed in a film on the developing roller 54 are continuously collected by the cleaning roller 58 as they are. The T/D of the liquid developer on the cleaning roller 58 at this time is about 60 wt %.

Figure 4:
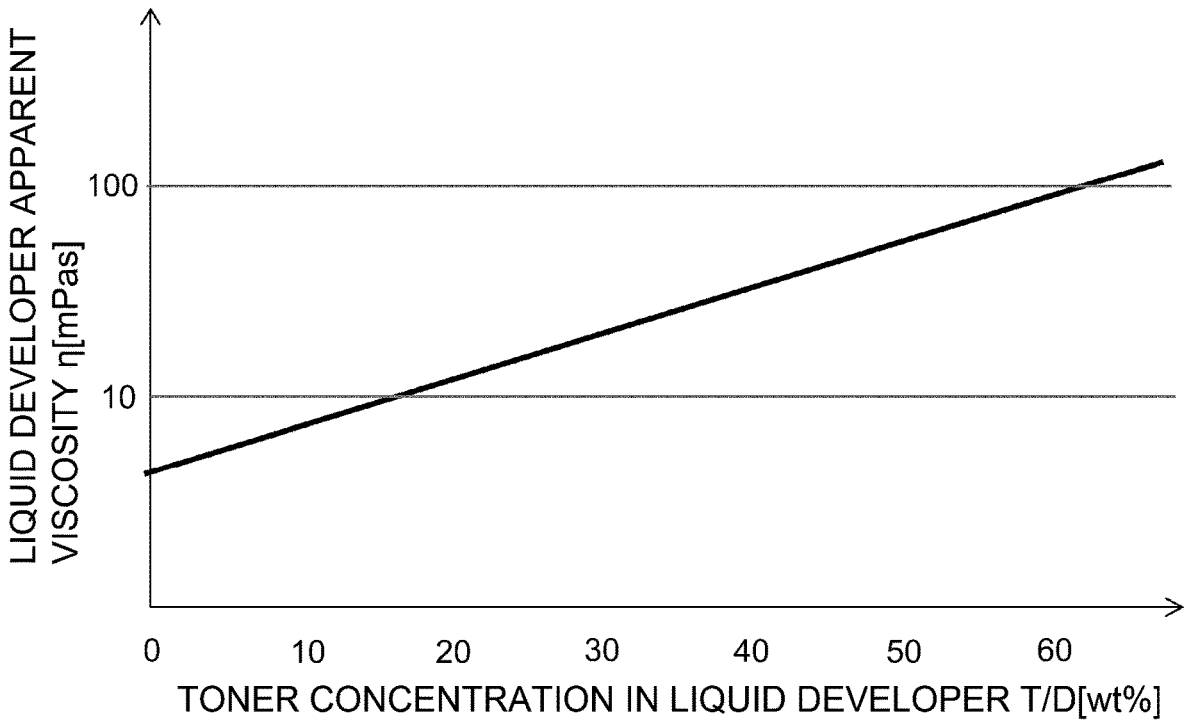
FIG. 4 is a graph showing a relationship between a toner concentration in a liquid developer and an apparent viscosity of the liquid developer.

In the case where the T/D of the liquid developer is high, apparent viscosity of the liquid developer becomes high. FIG. 4 is a graph showing a relationship between the apparent viscosity and the T/D of the liquid developer used in this embodiment. As is understood from FIG. 4, the apparent viscosity of the liquid developer collected on the cleaning roller 58 increases up to about 140 mPa·s in the highest case (the case where the T/D is about 65 wt %). Thus, in the case where the liquid developer high in apparent viscosity is scraped off by the cleaning blade 56, the liquid developer which is scraped off does not readily flow toward the developer collecting container 55 along the inclination of the surface of the cleaning blade 56. As a result of this, the toner particles are liable to stagnate at a free end portion, a surface-stepped portion and the like of the cleaning blade 56.

[Flushing]

Figure 5:
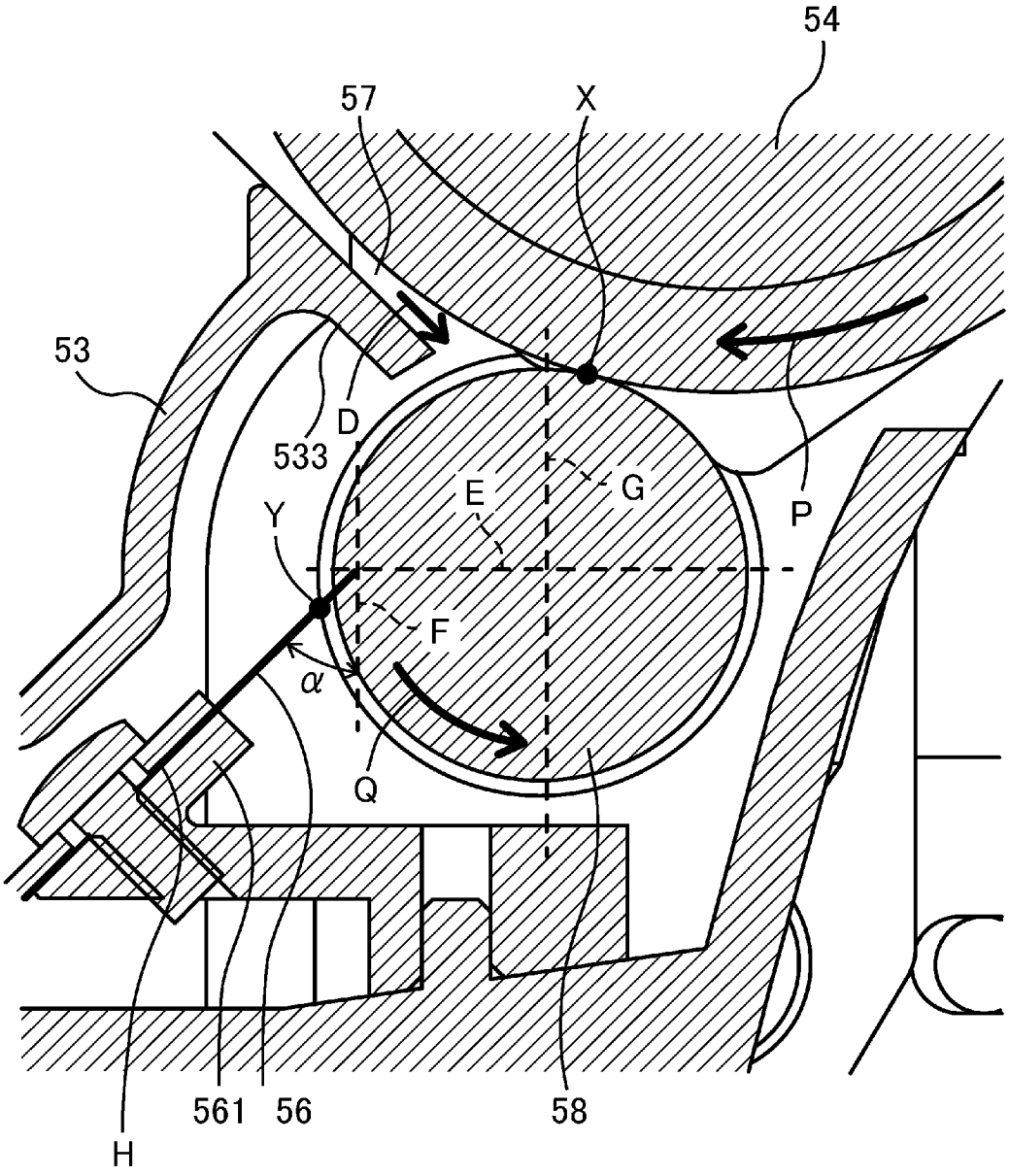
FIG. 5 is an enlarged view of a periphery of a cleaning roller of a developing device according to the First Embodiment.

In this embodiment, in order to alleviate stagnation of the toner particles due to the increase in T/D as described above, flushing is performed. That is, the liquid developer which was supplied to the developer container 53 and which is in a state in which the T/D is low (3.5±0.5 wt % in this embodiment) is caused to flow toward between a contact portion of the cleaning roller 58 with the cleaning blade 56 and the nip between the developing roller 54 and the cleaning roller 58. For this reason, in this embodiment, as shown in FIG. 5, the developer container 53 is capable of supplying the stored liquid developer between a cleaning position X and a contact position Y of the surface of the cleaning roller 58 with respect to the rotational direction of the cleaning roller 58. That is, the developer container 53 is capable of supplying the liquid developer to a side upstream of the contact position Y.

The cleaning position X is a position where the cleaning roller 58 contacts or is closest to the developing roller 54, and the contact position Y is a position where the free end portion of the cleaning blade 56 contacts the cleaning roller 58. Further, in FIG. 5, the cleaning blade 56 is shown in an extended state as it is without being elastically deformed, but in actuality, the cleaning blade 56 is elastically deformed along the surface of the cleaning roller 58.

Specifically, the developer container 53 includes the guiding member 533 provided on a side upstream of the film forming electrode 51 with respect to the rotational direction of the developing roller 54. The guiding member 533 guides a part of the liquid developer, supplied from the developer container 53 toward a predetermined gap between the developing roller 54 and the film forming electrode 51, toward the surface of the cleaning roller 58 by gravitation. That is, a portion of the developer container 53 on a side upstream of the film forming electrode 51 opposes the developing roller 54 with a gap therebetween, and the guiding member 533 extends from this portion toward between the cleaning position X and the contact position Y of the surface of the cleaning roller 58. Further, the flushing flow path 57 is formed between this guiding member 533 and the developing roller 54.

Thus, a part of the liquid developer supplied to the developer container 53 is caused to flow in the flushing flow path 57 provided at a portion below the film forming electrode 51, in an arrow D direction of FIGS. 2 and 5, so that a flushing function is realized. A gap (interval of the flushing flow path 57) between the developing roller 54 and the guiding member 533 is set at 300-1500 μm, preferably at 1000 μm.

By performing the flushing, the T/D of the liquid developer collected on the cleaning roller 58 is lowered to about 10 wt % at the maximum. As shown in FIG. 4, when the T/D is lowered to about 10 wt %, the apparent viscosity of the liquid developer lowers to about 8.0 mPa·s. For this reason, the liquid developer scraped off by the cleaning blade 56 readily flows down smoothly into the developer collecting container 55 without stagnating at the surface or the stepped portion of the cleaning blade 56.

The liquid developer collected from the developing roller 54 to the cleaning roller 58 and the liquid developer supplied to the cleaning roller 58 by the flushing are scraped off by the cleaning blade 56 and are collected in the developer collecting container 55. The liquid developer collected in the developer collecting container 55 is discharged through a developer discharge opening 551 and passes through an unshown circulating path, and is supplied again toward the mixer 59K.

[Mountable Range of Cleaning Blade]

As described above, in this embodiment, the liquid developer scraped off by the cleaning blade 56 is caused to readily flow down into the developer collecting container 55 by the flushing. However, unless a contact position and a contact angle of the cleaning blade 56 relative to the cleaning roller 58 are appropriate, there is a liability that scraping-off of the liquid developer by the cleaning blade 56 and a performance that the liquid developer flows down along the blade cannot be sufficiently ensured. In this case, there is a possibility that the image forming operation stops in a state in which the liquid developer is deposited on the cleaning roller 58 and the cleaning blade 56 and agglomeration, deposition and the like of the toner particles due to vaporization or the like of the carrier liquid occur.

In general, the toner particles in the liquid developer are dispersed in the carrier liquid in a state in which the toner particles are separated one by one, and form a stable state. In a state in which a periphery of the toner particles is sufficiently filled with the carrier liquid, principally, the dispersant and the like added during preparation of the toner particles form a barrier on a particle surface, and therefore, individual toner particles exist independently of each other, and are not deposited on a member contacting the developer.

However, in the case where the carrier liquid is decreased to the extent that a gap between the toner particles and a gap between the toner particle and the member cannot be filled with the carrier liquid, the toner particle forms an agglomerate with an adjacent toner particle or causes deposition on the member in some instances. That is, such agglomeration and deposition are caused by the influence of a liquid cross-linking force and an intermolecular force which acts between the toner particles and between the toner particle and the member.

Such a situation is liable to occur in the case where in the developing device using the liquid developer, the image forming operation is stopped in a state in which the toner particles remain on the respective member surfaces and between the respective members. Specifically, the above-described situation is liable to occur when on the surfaces of the drawing roller 52 and the cleaning member such as the cleaning roller 58 and in the nips of these members with the developing roller 54, residual toner is deposited during the stop of the image forming operation. That is, in this state, the carrier liquid at the periphery of the toner particles flows or vaporizes, and therefore, agglomeration of the toner particles and deposition of the toner particles on the members are caused.

When the thus generated agglomeration and deposited matter of the toner particles remain without being separated from a member surface layer during resumption of the operation by the developing device, there is a liability that malfunction of the member is caused. Further, in the case where the liquid developer is collected and utilized again, there is a liability that an increase in viscosity of the developer and a lowering in image quality during the image formation are caused. Accordingly, it is desired that the agglomeration of the toner particles and the deposition of the toner particles on the member are avoided for stable high-quality output.

Here, in the case where the above-described flushing is not performed, the T/D of the liquid developer on the surface of the cleaning roller 58 becomes high, and the viscosity of the liquid developer also becomes high. In this case, in order to scrape off the liquid developer on the surface of the cleaning roller 58 by the cleaning blade 56, it would be considered that an angle of the cleaning blade 56 relative to the cleaning roller 58 is brought near to the horizontal. However, in this case, the liquid developer does not readily flow down along the surface of the cleaning blade 56.

Therefore, in this embodiment, not only the above-described flushing is performed, but also the contact position and the contact angle of the cleaning blade 56 relative to the cleaning roller 58 are regulated in the following manner. Further, removal of the liquid developer on the cleaning roller 58 by the cleaning blade 56 is made easy, and the liquid developer is not readily left on the cleaning roller 58 and the cleaning blade 56.

A mountable range of the cleaning blade 56 in this embodiment will be described using FIG. 5 to FIG. 9. As described above, to the cleaning roller 58, the cleaning blade 56 is contacted. The cleaning blade 56 is the blade which is formed of stainless steel and which is 0.1 mm in thickness and 8 mm in free length, and is mounted to a fixing portion such is a casing of the developing device 50K via a blade supporting portion 561 as shown in FIG. 5.

The cleaning blade 56 is disposed so that a free end thereof enters an outer diameter (portion) of the cleaning roller 58. That is, the cleaning blade 56 is mounted so that the free end thereof enters a phantom circle corresponding to the cleaning roller 58 in the case where the cleaning blade 56 is in a free state. An entering amount of the cleaning blade 56 with respect to a radial direction of the phantom circle is 0.5-1.5 mm, preferably 1 mm as in this embodiment. The cleaning blade 56 cannot enter the cleaning roller 58 in actuality, so that the cleaning blade 56 contacts the surface of the cleaning roller 58 in a state in which the cleaning blade 56 is elastically deformed depending on this entering amount.

Figure 6:
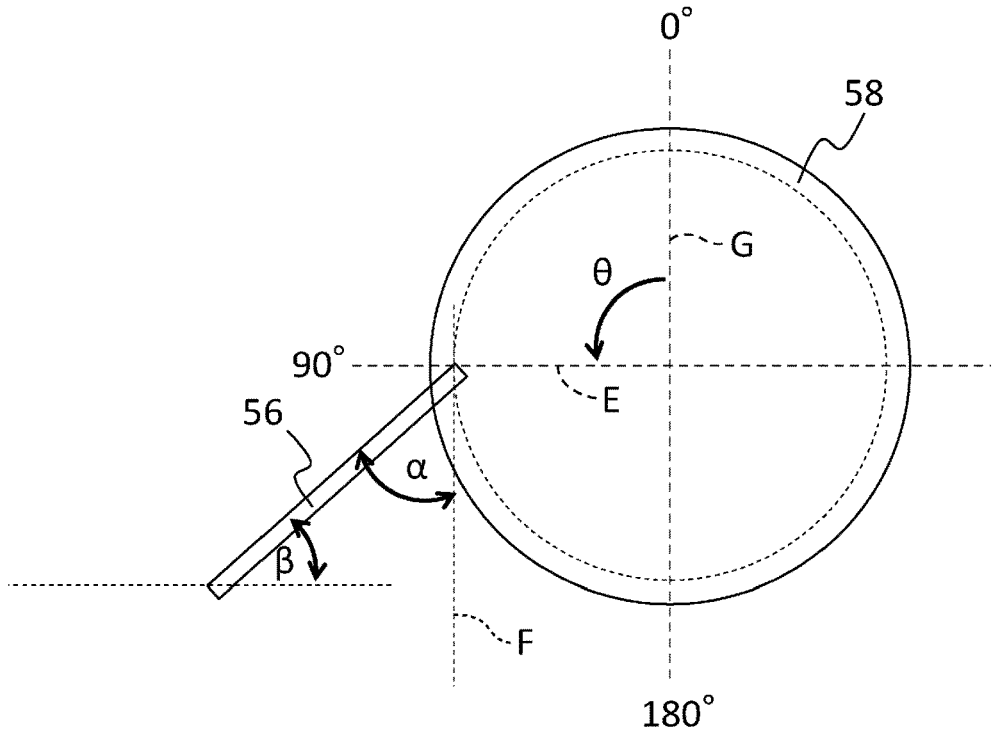
FIG. 6 is a schematic view showing a relationship between the cleaning roller according to the First Embodiment and an arrangement of a cleaning blade.

First, an angle α contributing to a performance of scraping off the liquid developer from the surface of the cleaning roller 58 by the cleaning blade 56 will be described. As shown in FIG. 6, the angle α is an angle between a line F perpendicular to a line E connecting a center of the cleaning roller 58 and the free end of the cleaning blade assuming that the cleaning blade 56 is in the free state, and the cleaning blade 56.

Incidentally, in actuality, the cleaning blade 56 is elastically deformed by the contact with the cleaning roller 58. For this reason, the angle α is an angle formed by a supporting surface H (FIG. 5) of the blade supporting portion 561 for supporting the cleaning blade 56 and by the line F. That is, the blade supporting portion 561 supports the cleaning blade 56 by the supporting surface H so as to contact a surface of a base end-side portion of the cleaning blade 56, and therefore, this base end-side portion is not elastically deformed. For this reason, the angle formed by the supporting surface H of the blade supporting portion 561 for supporting the base end-side portion of the cleaning blade 56 and by the line F is equal to the angle α formed by the cleaning blade 56 in the free state and by the line F. Further, the angle α is substantially equal to an angle formed by a line perpendicular to a line connecting the center of the cleaning roller 58 and a point of intersection of an extended line of the supporting surface H and the surface of the cleaning roller 58, and by the supporting surface H.

In this embodiment, this angle α is a range of 30° or more and less than 60°, preferably be 40° or more and less than 50°. According to study by the present inventors, it turned out that by setting the angle α at this range, in a constitution using the above-described flushing, the performance of scraping off the liquid developer containing the toner particles from the surface of the cleaning roller 58 by the cleaning blade 56 can be sufficiently ensured. In this embodiment, the angle α is 45°.

Next, an angle β contributing to a performance of smooth flow-down of the liquid developer on the cleaning blade 56 will be described. As shown in FIG. 6, the angle β is an angle formed by the cleaning blade 56 and the horizontal surface assuming that the cleaning blade 56 is in the free state. In other words, an angle formed by the supporting surface H and the horizontal surface is the angle β. In this embodiment, this angle is 35° or more, preferably be 40° or more. According to study by the present inventors, it turned out that by setting the angle β at this range, in the constitution using the above-described flushing, the performance of smooth flow-down of the liquid developer scraped off by the cleaning blade 56 into the developer collecting container 55 can be sufficiently ensured. In this embodiment, the angle β is 45°.

Accordingly, the cleaning blade 56 may preferably be mounted in a range in which a mountable range of the angle α and a mountable range of the angle β overlap with each other.

Here, the contact position Y between the cleaning blade 56 and the cleaning roller 58 is defined. First, a line passing through the center of the cleaning roller 58 and an upper end portion of the cleaning roller 58 with respect to the direction of gravitation is at 0° (reference line G). Further, in the case where an angle of the rotational direction of the cleaning roller 58 is a positive angle, an angle formed by the reference line G of 0° and the line E connecting the free end of the cleaning blade and the center of the cleaning roller 58 assuming that the cleaning blade 56 is in the free state is θ. That is, assuming that the free end of the cleaning blade 56 in the free state is positioned at a position of the angle θ from the reference line G, a position where the cleaning blade 56 actually contacts the cleaning roller 58 is the contact position Y.

Figure 7:
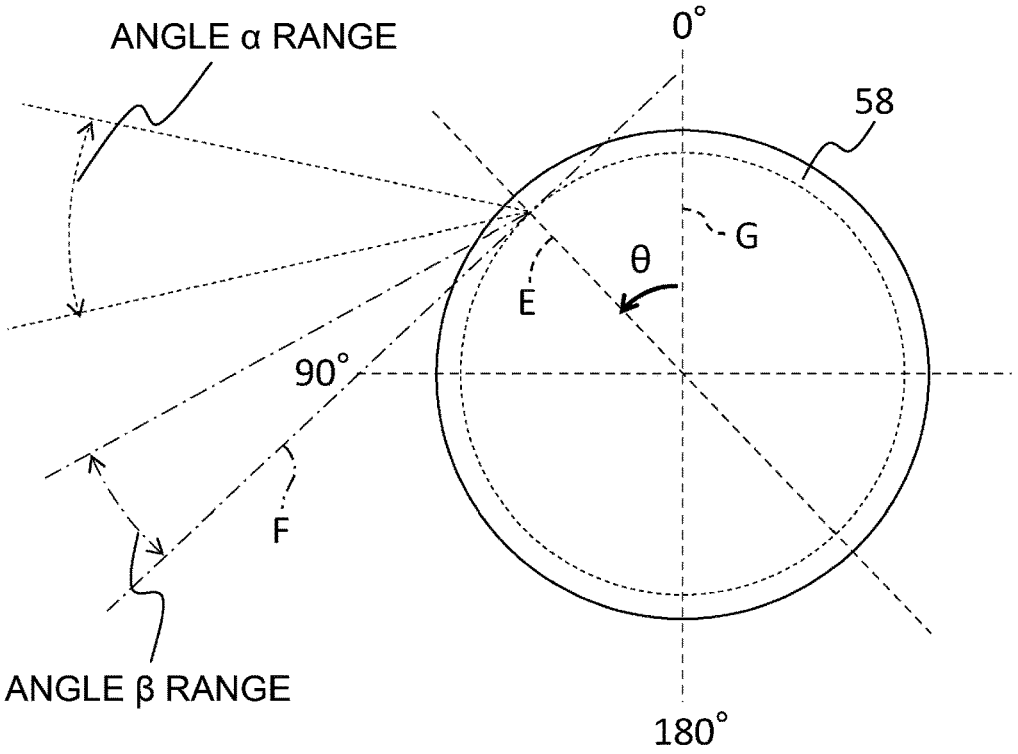
FIG. 7 is a schematic view for illustrating the case where a position of the cleaning blade is in a range of 0° or more and less than 65° in terms of an angle θ.

FIG. 7 is a view showing a state when the above-described angle θ is 0°≤θ<65°. At this time, there is no overlapping range between the mountable range of the angle α (angle α range) and the mountable range of the angle β (angle β range). For this reason, in the case where the angle θ is 0° or more and less than 65°, the cleaning blade 56 has no mountable range.

Figure 8:
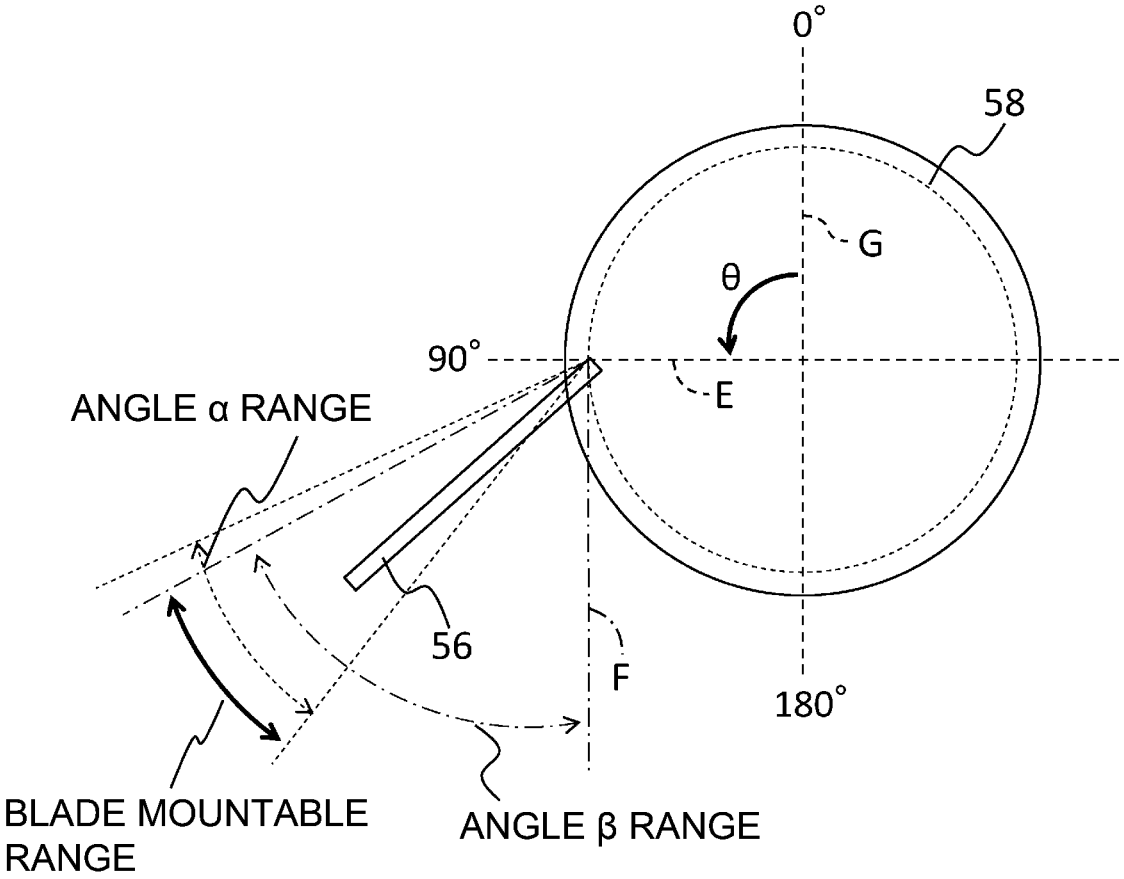
FIG. 8 shows schematic view for illustrating the case where the position of the cleaning blade according to the First Embodiment is in a range of 65° or more and less than 95° in terms of the angle θ.

FIG. 8 is a view showing a state when the above-described angle θ is 65°≤θ<95°. At this time, the mountable range of the angle α (angle α range) and the mountable range of the angle β (angle β range) overlap with each other in a range (blade mountable range) shown in FIG. 8. Accordingly, when the angle θ is 65°≤θ<95°, the cleaning blade 56 has a mountable range of 35° or more and less than 60° in terms of the angle α.

That is, the free end of the cleaning blade 56 positions in the range of 65° or more and less than 95° as the positive angle from the reference line G in the rotational direction of the cleaning roller 58 assuming that the cleaning blade 56 is in the free state. In this case, the cleaning blade 56 is disposed so that the angle α formed by the line F perpendicular to the line E connecting the center of the cleaning roller 58 and the free end of the cleaning blade 56, and by the cleaning blade 56 is the range of 35° or more and less than 60°.

Figure 9:
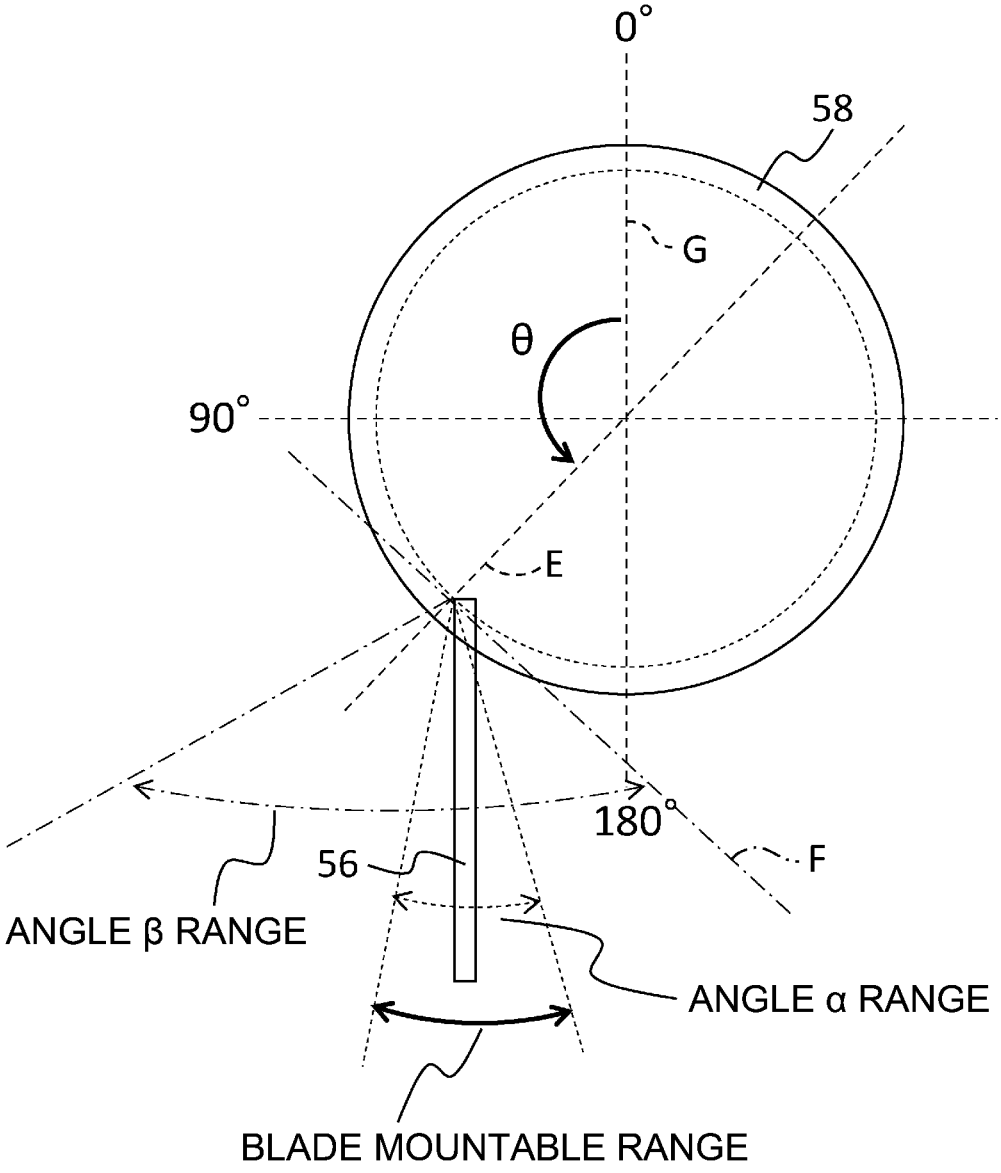
FIG. 9 is a schematic view for illustrating the case where the position of the cleaning blade according to the First Embodiment is a range of 95° or more and less than 180° in terms of the angle θ.

FIG. 9 is a view showing a state when the above-described angle θ is 95°≤θ<180°. At this time, the mountable range of the angle α (angle α range) and the mountable range of the angle β (angle β range) overlap with each other in a range (blade mountable range) shown in FIG. 9. Accordingly, when the angle θ is 95°≤θ<180°, the cleaning blade 56 has a mountable range of 30° or more and less than 60° in terms of the angle α.

That is, the free end of the cleaning blade 56 positions in the range of 95° or more and less than 180° as the positive angle from the reference line G in the rotational direction of the cleaning roller 58 assuming that the cleaning blade 56 is in the free state. In this case, the cleaning blade 56 is disposed so that the angle α formed by the line F perpendicular to the line E connecting the center of the cleaning roller 58 and the free end of the cleaning blade 56, and by the cleaning blade 56 is the range of 30° or more and less than 60°.

In this embodiment, not only the flushing is performed as described above, but also the cleaning blade 56 is mounted in the above-described range. For this reason, it is possible to realize improvement in performance of the cleaning roller 58 for removing the toner particles which do not contribute to the image formation and which remain on the developing roller 54 and of the cleaning blade 56 and to realize suppression of deposition of the toner particles on the cleaning roller 58 and the cleaning blade 56.

Particularly, in this embodiment, the liquid developer on the cleaning roller 58 can be removed by a simple constitution, and in addition, the liquid developer can be made hard to remain on the cleaning blade 56. That is, in the case of the constitution described in Japanese Laid-Open Patent Application 2014-115652, the constitution is such that the liquid developer is blown onto the blade by the cleaning unit, and therefore, the constitution becomes complicated. On the other hand, in the case of this embodiment, the liquid developer is directly supplied from the developer container 53 to the surface of the cleaning roller 58 (the flushing is performed), and therefore, the constitution is simple.

Further, by thus performing the flushing, the T/D of the cleaning roller 58 can be lowered, and the angles 6a& and β of the cleaning blade 56 can be set as described above. If in the case where the flushing is not performed, the scraping-off performance of the cleaning blade 56 by increasing the angle α, but in this case, the angle β is not readily set at the above-described range. Then, the liquid developer does not readily flow down on the surface of the cleaning blade 56, so that there is a liability that the liquid developer remains on the surface of the cleaning blade 56. On the other hand, in the case of this embodiment, the angle β can be set as described above, and therefore, the liquid developer can be made hard to remain on the cleaning blade 56.

That is, in the case of this embodiment, by the simple constitution, it is possible to compatibly realize ensuring of the scraping-off performance of the liquid developer by the cleaning blade 56 and ensuring of the flowing-down performance of the liquid developer on the cleaning blade 56. As a result of this, in the case where the image forming operation is stopped, it is possible to suppress the agglomeration of the toner particles on the surfaces of the cleaning blade 56 and the cleaning roller 58 and to suppress the deposition of the toner particles on the surfaces of the cleaning blade 56 and the cleaning roller 58.

Second Embodiment

Figure 10:
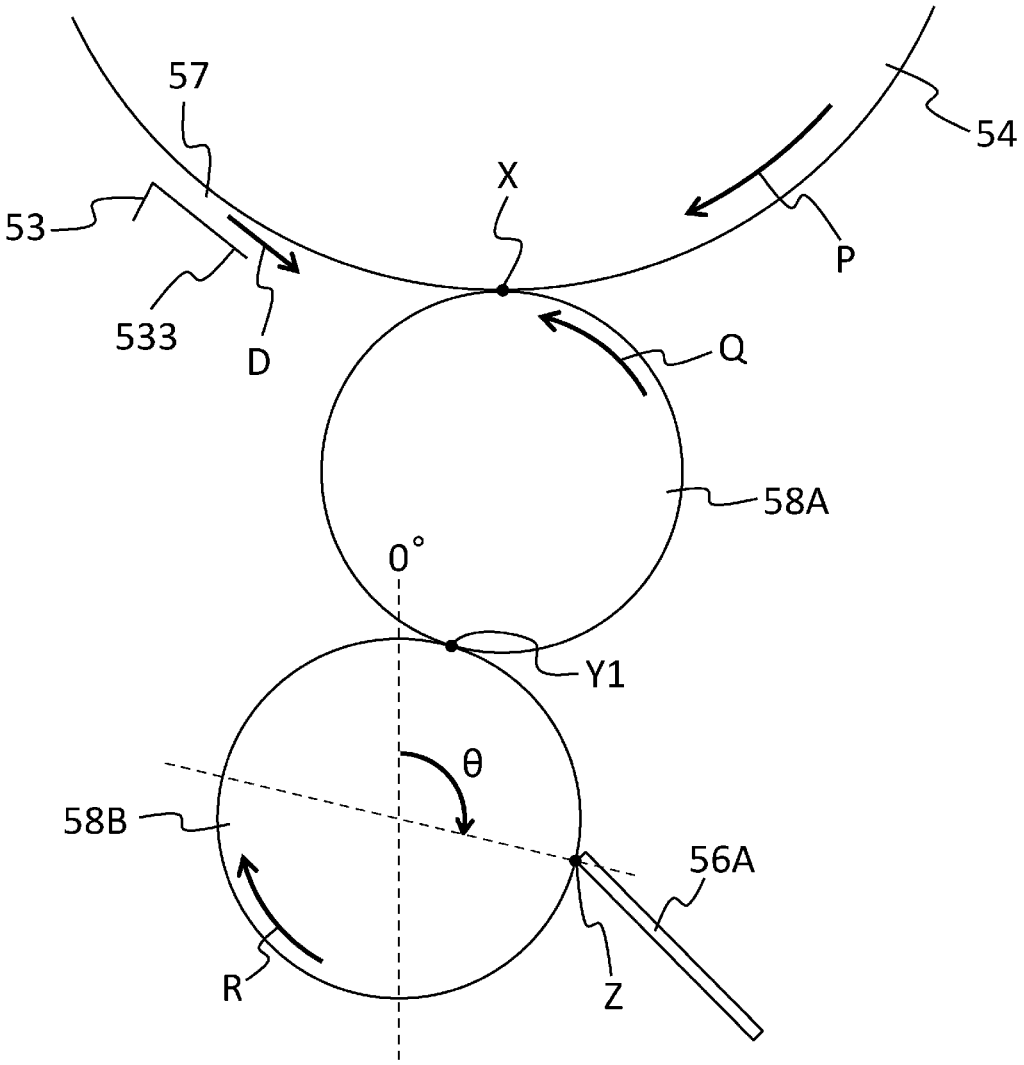
FIG. 10 is a schematic view of a periphery of first and second cleaning rollers according to Second Embodiment.

Second Embodiment will be described using FIG. 10. In the above-described First Embodiment, the case of the single cleaning roller was described, but in this embodiment, there are two cleaning rollers. Other constitutions and actions are similar to those in the above-described First Embodiment, and therefore, redundant description and illustration are omitted or briefly made, and in the following, a portion different from the First Embodiment will be principally described.

In this embodiment, a first cleaning roller 58A as a first cleaning roller rotates while removing the liquid developer on the developing roller 54 at a first cleaning position X on a side downstream of a developing position with respect to a rotational direction (arrow P direction) of the developing roller 54. Further, a second cleaning roller 58B as a second cleaning roller is provided at a second cleaning position Y1 on a side downstream of the first cleaning position X with respect to a rotational direction (arrow Q direction) of the first cleaning roller 58A. The second cleaning roller 58B rotates while removing the liquid developer on the first cleaning roller 58A (on the first cleaning roller). The rotational direction of the second cleaning roller 58B is opposite to the rotational direction of the first cleaning roller 58A. Thus, the liquid developer on the developing roller 54 is removed by the second cleaning roller 58B via the first cleaning roller 58A.

Further, a cleaning blade 56A contacts the second cleaning roller 58B at a contact position Z on a side downstream of the second cleaning position Y1 with respect to a rotational direction (arrow R direction) of the second cleaning roller 58B. Further, the cleaning blade 56A scrapes off the liquid developer on the second cleaning roller 58B (on the second cleaning roller). A contact position and a contact angle of the first cleaning blade 56A relative to the second cleaning roller 58B are similar to those in the First Embodiment.

Assuming that the cleaning blade 56A is in a free state, a line passing through a center of the second cleaning roller 58B and an upper end portion of the cleaning roller 58B with respect to the direction of gravitation is at 0°. In this case, a free end of the cleaning blade 56A is positioned in a range of 65° or more and less than 95° as a positive angle with respect to the rotational direction of the second cleaning roller 58B from the line of 0°. Further, cleaning blade 56A is disposed so that an angle between a line perpendicular to a line connecting the center of the second cleaning roller 58B and the free end of the cleaning blade 56A, and the cleaning blade 56A is in a range of 35° or more and less than 60°.

Or, a free end of the cleaning blade 56A is positioned in a range of 95° or more and less than 180° as a positive angle with respect to the rotational direction of the second cleaning roller 58B from the line of 0°. In this case, cleaning blade 56A is disposed so that an angle between a line perpendicular to a line connecting the center of the second cleaning roller 58B and the free end of the cleaning blade 56A, and the cleaning blade 56A is in a range of 30° or more and less than 60°.

Further, the developer container 53 is capable of supplying the liquid developer to a surface of the first cleaning roller 58A or the second cleaning roller 58B. That is, the developer container 53 is capable of performing flushing for supplying the liquid developer to a portion, of this surface, between the first cleaning position X to the contact position Z with respect to the rotational directions of the first cleaning roller 58A and the second cleaning roller 58B.

In this embodiment, the developer container 53 is capable of supplying the liquid developer to a portion, of the surface of the first cleaning roller 58A, between the first cleaning position X and the second cleaning position Y1 with respect to the first cleaning roller 58A. The guiding member 533 of the developer container 53 is extended toward this range on the surface of the first cleaning roller 58A.

Incidentally, the liquid developer of the developer container 53 may also be supplied to a portion, of the surface of the second cleaning roller 58B, between the second cleaning PY1 and the contact position Z with respect to the rotational direction of the second cleaning roller 58B. In summary, the liquid developer of the developer container 53 may only be required to be supplied to a side upstream of the contact position.

Also in such this embodiment, by a simple constitution, the liquid developer on the second cleaning roller 58B can be removed, and in addition, the liquid developer on the first cleaning roller 58A can be made hard to remain on the cleaning blade 56A.

Other Embodiments

In the above-described Second Embodiment, the case of the two cleaning rollers was described, but the present invention is similarly applicable to also the case where there are three or more cleaning rollers. Even in either case, the liquid developer may only be required to be supplied from the developer container toward a side upstream of the contact position, where the cleaning blade contacts the cleaning roller, with respect to the rotational directions of the respective cleaning rollers. Further, the intermediary transfer member may also be, for example, a drum in addition to the endless belt.

INDUSTRIAL APPLICABILITY

According to the present invention, there is provided a developing device capable of removing the liquid developer on the cleaning roller by a simple constitution and capable of making the liquid developer hard to remain on the cleaning blade.

EXPLANATION OF SYMBOLS

20Y, 20M, 20C, 20K . . . photosensitive member (image bearing member)/50Y, 50M, 50C, 50K . . . developing device/51 . . . film forming electrode/53 . . . developer container/54 . . . developing roller (developer carrying member)/56 . . . cleaning blade (cleaning blade, blade)/58 . . . cleaning blade (cleaning roller, roller)/58A . . . first cleaning roller (first cleaning roller)/58B . . . second cleaning roller (second cleaning roller)/533 . . . guiding member

The invention claimed is:

1. A developing device comprising:

a developer carrying member, rotatable while carrying a liquid developer including toner and a carrier liquid, for developing an electrostatic latent image carried on an image bearing member with the liquid developer at a developing position;

a developer container for accommodating the liquid developer and capable of supplying the accommodated liquid developer to said developer carrying member;

a cleaning roller for removing the liquid developer on said developer carrying member at a cleaning position downstream of the developing position and upstream of a position where the liquid developer starts to be supplied to said developer carrying member by said developer container with respect to a rotational direction of said developer carrying member; and a cleaning blade for scraping off the liquid developer on said cleaning roller in contact with said cleaning roller at a contact position downstream of the cleaning position with respect to a rotational direction of said cleaning roller and upstream of a lower end portion of said cleaning roller with respect to a direction of gravitation, wherein said developer container is capable of supplying the accommodated liquid developer to a portion of a surface of said cleaning roller downstream of the cleaning position and upstream of the contact position with respect to the rotational direction of said cleaning roller, and wherein said cleaning blade is provided such that, when in a free state:

when a line passing through a center of said cleaning roller and an upper end portion of said cleaning roller with respect to the direction of gravitation is at 0°, an angle of the rotational direction of said cleaning roller is a positive angle and a free end of said cleaning blade is positioned in a range of 65° or more and 95° or less, and an angle formed, downstream of the rotational direction of said cleaning roller, between a line perpendicular to a line connecting the center of said cleaning roller and the free end of said cleaning blade, and said cleaning blade, is in a range of 35° or more and 60° or less.

2. A developing device according to claim 1, further comprising a film forming electrode, provided opposed to said developer carrying member with a predetermined gap, for forming a film of the liquid developer on said developer carrying member, wherein said developer container is capable of supplying the liquid developer to said developer carrying member by supplying the accommodated liquid developer to the predetermined gap.

3. A developing device according to claim 2, further comprising a guiding portion, provided upstream of said film forming electrode and downstream of the cleaning position with respect to the rotational direction of said developer carrying member, for guiding a part of the liquid developer, supplied from said developer container toward the predetermined gap, toward a surface of said cleaning roller by gravitation.

4. A developing device comprising:

a developer carrying member, rotatable while carrying a liquid developer including toner and a carrier liquid, for developing an electrostatic latent image carried on an image bearing member with the liquid developer at a developing position;

a developer container for accommodating the liquid developer and capable of supplying the accommodated liquid developer to said developer carrying member;

a first cleaning roller for removing the liquid developer on said developer carrying member at a first cleaning position downstream of the developing position and upstream of a position where the liquid developer starts to be supplied to said developer carrying member by said developer container with respect to a rotational direction of said developer carrying member;

a second cleaning roller for removing the liquid developer on said first cleaning roller at a second cleaning position downstream of the first cleaning position with respect to a rotational direction of said first cleaning roller; and a cleaning blade for scraping off the liquid developer on said second cleaning roller in contact with said second cleaning roller at a contact position downstream of the second cleaning position with respect to a rotational direction of said second cleaning roller and upstream of a lower end portion of said second cleaning roller with respect to a direction of gravitation, wherein said developer container is capable of supplying the accommodated liquid developer to portion of a surface of said first cleaning roller downstream of the first cleaning position and the contact position with respect to the rotational direction of said first cleaning roller, and wherein said cleaning blade is provided such that, when in a free state:

when a line passing through a center of said second cleaning roller and an upper end portion of said second cleaning roller with respect to the direction of gravitation is at 0°, an angle of the rotational direction of said second cleaning roller is a positive angle and a free end of said cleaning blade is positioned in a range of 65° or more and 95° or less, and an angle, formed downstream of the rotational direction of said second cleaning roller, between a line perpendicular to a line connecting the center of said second cleaning roller and the free end of said cleaning blade, and said cleaning blade, is in a range of 35° or more and 60° or less.

5. A developing device according to claim 4, further comprising a film forming electrode, provided opposed to said developer carrying member with a predetermined gap, for forming a film of the liquid developer on said developer carrying member, wherein said developer container is capable of supplying the liquid developer to said developer carrying member by supplying the accommodated liquid developer to the predetermined gap.

6. A developing device according to claim 5, further comprising a guiding portion, provided upstream of said film forming electrode and downstream of the first cleaning position with respect to the rotational direction of said developer carrying member, for guiding a part of the liquid developer, supplied from said developer container toward the predetermined gap, toward a surface of said first cleaning roller by gravitation.

7. A developing device comprising:

a developer carrying member, rotatable while carrying a liquid developer including toner and a carrier liquid, for developing an electrostatic latent image carried on an image bearing member with the liquid developer at a developing position;

a developer container for accommodating the liquid developer and capable of supplying the accommodated liquid developer to said developer carrying member;

a first cleaning roller for removing the liquid developer on said developer carrying member at a first cleaning position downstream of the developing position with respect to a rotational direction of said developer carrying member and upstream of a position where the liquid developer starts to be supplied to said developer carrying member by said developer container;

a second cleaning roller for removing the liquid developer on said first cleaning roller at a second cleaning position downstream of the first cleaning position with respect to a rotational direction of said first cleaning roller; and a cleaning blade for scraping off the liquid developer on said second cleaning roller in contact with said second cleaning roller at a contact position downstream of the second cleaning position with respect to a rotational direction of said second cleaning roller and upstream of a lower end portion of said second cleaning roller with respect to a direction of gravitation, wherein said developer container is capable of supplying the accommodated liquid developer to a portion of a surface of said second cleaning roller downstream of the second cleaning position and upstream of the contact position with respect to the rotational direction of said second cleaning roller, and wherein said cleaning blade is provided such that, when in a free state:

when a line passing through a center of said second cleaning roller and an upper end portion of said second cleaning roller with respect to the direction of gravitation is at 0° , an angle of the rotational direction of said second cleaning roller is a positive angle and a free end of said cleaning blade is positioned in a range of 65° or more and 95° or less, and an angle, formed downstream of the rotational direction of said second cleaning roller, between a line perpendicular to a line connecting the center of said second cleaning roller and the free end of said cleaning blade, and said cleaning blade, is in a range of 35° or more and 60° or less.

8. A developing device according to claim 7, further comprising a film forming electrode, provided opposed to said developer carrying member with a predetermined gap, for forming a film of the liquid developer on said developer carrying member, wherein said developer container is capable of supplying the liquid developer to said developer carrying member by supplying the accommodated liquid developer to the predetermined gap.

9. A developing device according to claim 8, further comprising a guiding portion, provided upstream of said film forming electrode with respect to the rotational direction of said developer carrying member, for guiding a part of the liquid developer, supplied from said developer container toward the predetermined gap, toward a surface of said second cleaning roller by gravitation.

* * * * *